US006908304B2

(12) United States Patent
Fujita

(10) Patent No.: US 6,908,304 B2
(45) Date of Patent: Jun. 21, 2005

(54) HEAT TREATING DEVICE FOR SYNTHETIC FIBER YARN

(75) Inventor: Atsuhisa Fujita, Tokyo (JP)

(73) Assignee: Toyo Electric Co., Ltd., Tokyo (JP)

( * ) Notice: Subject to any disclaimer, the term of this patent is extended or adjusted under 35 U.S.C. 154(b) by 0 days.

(21) Appl. No.: 10/490,152

(22) PCT Filed: Sep. 27, 2002

(86) PCT No.: PCT/JP02/10028

§ 371 (c)(1),
(2), (4) Date: Mar. 18, 2004

(87) PCT Pub. No.: WO03/031702

PCT Pub. Date: Apr. 17, 2003

(65) Prior Publication Data

US 2004/0247304 A1 Dec. 9, 2004

(30) Foreign Application Priority Data

Oct. 5, 2001 (JP) ..... 2001-310632

(51) Int. Cl.[7] ..... F27B 9/28
(52) U.S. Cl. ..... 432/59; 34/611; 26/106
(58) Field of Search ..... 432/8, 59; 264/210.05, 264/211.17, 288.8; 34/611; 26/106

(56) References Cited

U.S. PATENT DOCUMENTS 3,819,776 A * 6/1974 Robinson et al. ..... 264/40.3
4,681,536 A * 7/1987 Jansen ..... 432/59
5,581,909 A * 12/1996 Ueda et al. ..... 34/636
5,855,476 A * 1/1999 Gottschalk ..... 432/59
5,946,821 A * 9/1999 Winheim ..... 34/611

FOREIGN PATENT DOCUMENTS

| | | |
|---|---|---|
| JP | 42-19547 | 11/1967 |
| JP | 45-31774 | 12/1970 |
| JP | 46-2092 | 1/1971 |
| JP | 52-24412 | 2/1977 |

* cited by examiner

*Primary Examiner*—Gregory Wilson
(74) *Attorney, Agent, or Firm*—Price, Heneveld, Cooper, DeWitt & Litton

(57) ABSTRACT

When a heat treatment device for heating synthetic fiber filament yarns by saturated steam is installed to a drawing and texturing device for synthetic fiber filament yarns, in order to lower the total height of the devices than a conventional one, cylindrical hot pins each having a heat-absorbing part and a heat-discharging part are formed integrally with the bottom surface of a laterally extended container for sealing saturated steam of heat medium liquid in such a fashion as to penetrate through the bottom surface from inside to outside of the container with axes of the hot pins extending in a vertical direction, and the level of surface of the heat medium liquid within the boiler connected with the container is disposed at a position lower than the inside bottom surface of the container.

6 Claims, 6 Drawing Sheets

HEAT TREATING DEVICE FOR SYNTHETIC FIBER YARN

TECHNICAL FIELD

This invention relates to a heat treatment device for heating synthetic fiber filament yarns at a uniform saturation temperature by a heat discharging part of each hot pin which is arranged to protrude from any of peripheral surfaces of a laterally extended closed container including its bottom surface by utilizing characteristics of saturated steam of heat medium liquid.

BACKGROUND ART

For the reasons that in a heat treatment device for synthetic fiber filament yarns of this kind which utilizes characteristics of saturated steam of heat medium liquid, the heat medium liquid condensed during heat treatment is returned to a boiler for heating the heat medium liquid without accumulating it inside hot pins, the heat treatment device cannot be mounted to a bottom surface of a laterally extended closed container in such a fashion as to protrude downwardly. Therefore, the heat treatment device is mounted to a side surface so as to protrude sidewardly. So, when the heat treatment device is installed above a separate vertically extended hot plate which is longer in vertical direction, the overall height of a setup comprising the heat treatment device and the hot plate increases, as a result it becomes difficult to secure a building in which the setup can be installed.

Such a tendency is remarkable particularly when the length of the vertically extended hot plate is lengthened with the increase of a feeding speed of the filament yarns.

In the heat treatment device for synthetic fiber filament yarns which utilizes characteristics of saturated steam of the heat medium liquid via the heating surface of the hot pins as described above, it is an object of the present invention to reduce the overall height of the setup comprising the heat treatment device and the hot pins by making it possible to arrange the heat treatment device on the same plane with the laterally extended hot plate instead of arranging the heat treatment device above the vertically extended hot plate so that a building for installing the setup therein can be easily secured.

DISCLOSURE OF THE INVENTION

A heat treatment device for synthetic fiber filament yarns according to the present invention employs a construction in which cylindrical hot pins each having a heat absorbing part and a heat discharging part are integrally formed with a bottom surface of a laterally extended closed container for closing saturated steam of heat medium liquid in such a fashion as to penetrate through the bottom surface from the inside to the outside of the closed container with axes of the hot pins extending in a vertical direction, a boiler for the heat medium liquid is provided to the bottom surface and a level of a heat medium liquid surface inside the boiler is arranged at a position lower than the bottom surface inside the laterally extended closed container.

In the heat treatment device described above, a heat transfer surface having a concavo-convex groove is formed on at least an outer peripheral surface of the heat absorbing part of the cylindrical hot pin positioned inside the closed container, a heat transfer surface having a concavo-convex groove is formed on at least an end face of the heat absorbing part of the cylindrical hot pin positioned inside the closed container, and communication holes are formed in such a fashion as to extend from one side surface to the other of the outer peripheral surface of the heat absorbing part of the cylindrical hot pin positioned inside the closed container.

BEST MODE FOR CARRYING OUT THE PRESENT INVENTION

Figure 1:
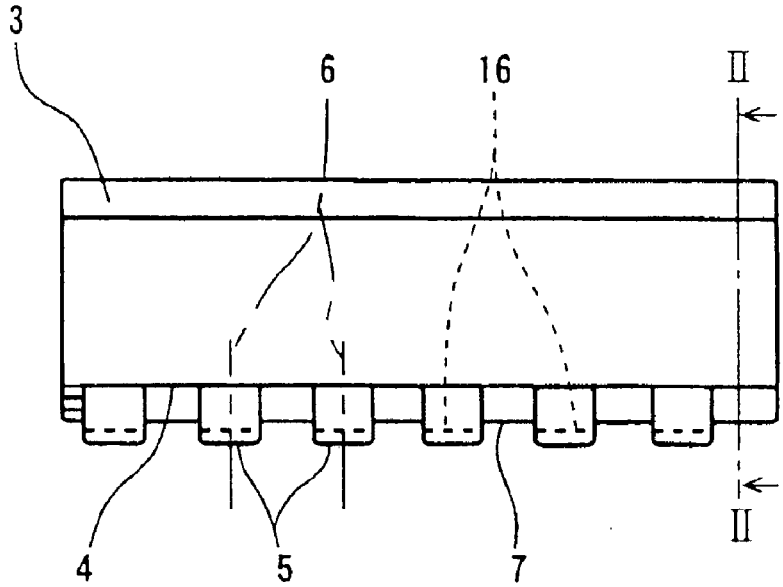
FIG. 1 is a front view showing an embodiment of the present invention.
Figure 2:
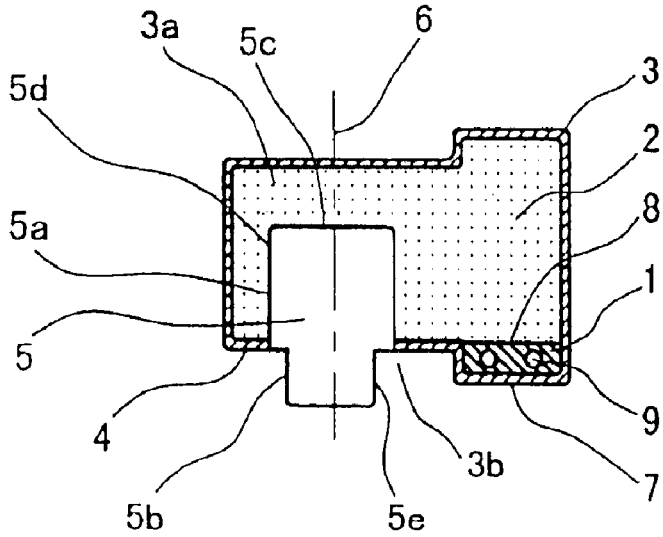
FIG. 2 is a sectional view taken along the line II—II of FIG. 1.
Figure 3:
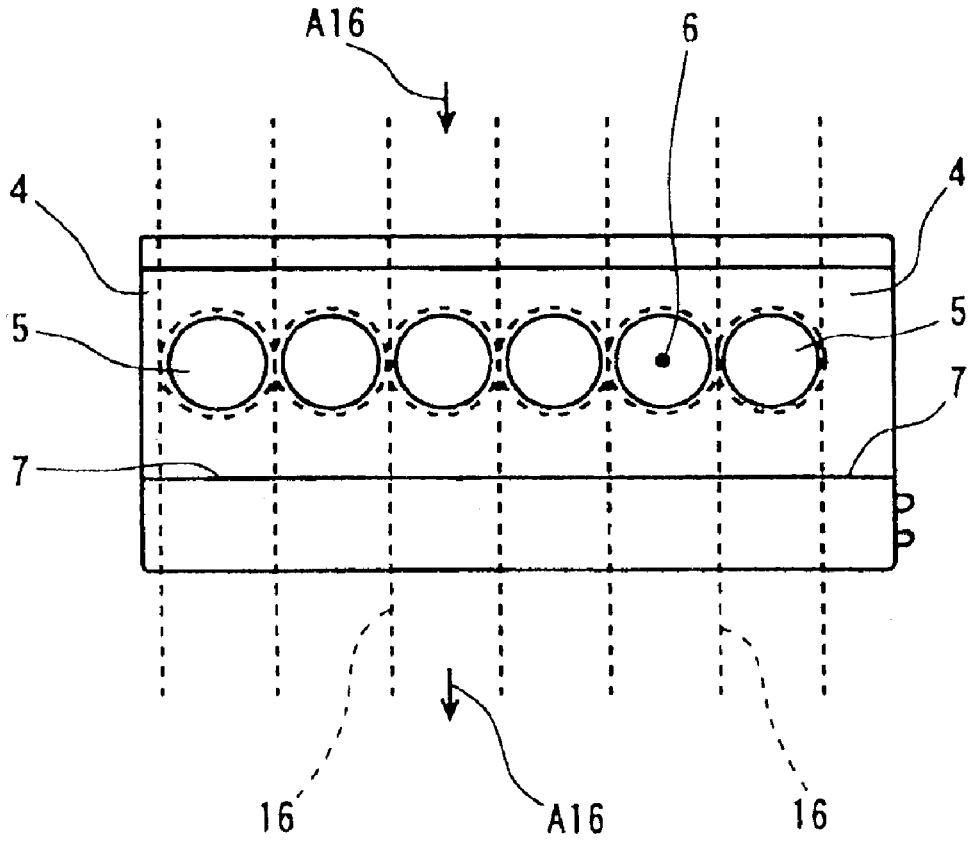
FIG. 3 is a bottom view of FIG. 1.

The most preferred embodiment for carrying out the present invention is shown in FIGS. 1 to 3. A plurality of cylindrical hot pins 5 each having a heat absorbing part 5*a* and a heat discharging part 5*b* are integrally fixed to a bottom surface 4 of a laterally extended closed container 3 for closing saturated steam 2 of a heat medium liquid 1 in such a fashion as to penetrate through the bottom surface 4 from the inside 3*a* of the closed container 3 to its outside 3*b* with an axis 6 of each hot pin 5 extending in a vertical direction, and a boiler 7 for the heat medium liquid 1 is provided to the bottom surface 4 of the laterally extended closed container 3 in such a fashion that the level of a heat medium liquid surface 8 inside the boiler 7 is arranged at a position lower than the bottom surface 4 inside the closed container 3.

When the heat treatment device of the present invention is used, the heat medium liquid 1 inside the boiler 7 is heated by a heater 9 such as an electric heating wire embedded in the heat medium liquid 1 so that the inside of the closed container 3 and the upper space of the heat medium liquid surface 8 inside the boiler 7 can be filled with the saturated steam 2 of the heat medium liquid.

Saturation temperature of the saturated steam 2 inside the closed container 3 heats an outer peripheral surface 5*d* and an end surface 5*c* of the heat absorbing part 5*a* of each hot pin 5 positioned inside the closed container 3. Heat is conducted through the hot pins 5 to a heating surface 5*e* of the heat discharging part 5*b* of each hot pin 5 positioned outside the closed container 3 and the temperature of the heating surface 5*e* is raised to the saturation temperature of the saturated steam 2 of the heat medium liquid 1.

Under this condition, the filament yarns 16 of the synthetic fiber to be heat-treated are wound round the heating surface 5*e* of the hot pins 5 having the axes 6 thereof extending in a vertical direction as shown in FIGS. 1 to 3, and allowed to travel in a direction indicated by an arrow A16, and then heated by latent heat of the saturated steam 2 inside the laterally extending closed container 3. A part of the saturated steam losing its latent heat is condensed and changes to the state of a heat medium solution. The solution flows down along the bottom surface 4 inside the closed container 3 onto the heat medium liquid surface 8 inside the boiler 7 which is arranged at the position lower than the bottom surface 4. The solution is thereby heated by the heater 9 and changes again to the state of the saturated steam 2.

During this operation, because the saturated steam 2 changes to the state of the heat medium liquid and then changes to the state of the saturated steam 2 due to its properties while keeping the saturation pressure and the saturation temperature constant inside the closed container 3, the heating temperature of the heating surface 5*e* of the heat discharging part 5*b* always heats the filament yarns 16 described above at a predetermined temperature throughout their full length.

Figure 8:
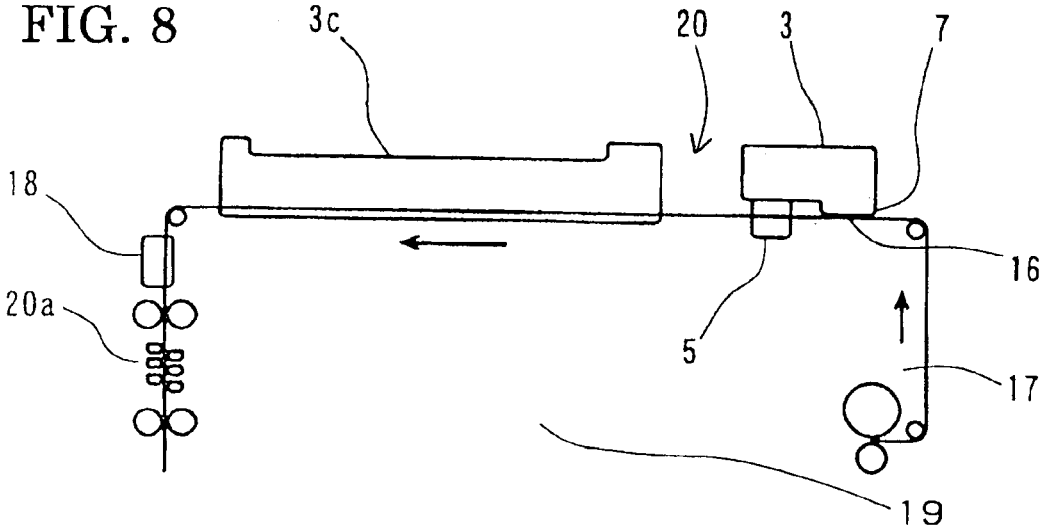
FIG. 8 is a side view of a setup when a heat treatment device for synthetic fiber filament yarns according to the present invention is arranged.

The heat treatment device for the synthetic fiber filament yarns according to the present invention comprises a plurality of cylindrical hot pins 5 each having the heat absorbing part 5*a* and the heat discharging part 5*b* and each being integrally fixed to the bottom surface 4 of the laterally extended closed container 3 for closing the saturated steam 2 of the heat medium liquid 1 in such a fashion as to penetrate through the bottom surface 4 from the inside 3*a* of the closed container 3 to its outside 3*b* with the axes 6 of the hot pins 5 extending in a vertical direction. Therefore, when the heat treatment device is juxtaposed with a laterally extended hot plate 3*c* on the same plane and above a space 19 between a filament yarn feeder 17 and a cooling plate 18 of a drawing and texturing (false-twisting) device 20 as shown in FIG. 8, the saturated steam 2 does not flow into the hot pin 5 but heats only through the outer peripheral surface 5*d* of the heat absorbing part 5*a* of each hot pin 5 although the heat discharging part 5*b* is in the state of protruding outwardly from the bottom surface 4. In consequence, the heat medium liquid does not build up inside the hot pin 5 and the heat discharging part 5*b* of the hot pin 5 is heated to the predetermined temperature by the saturation temperature of the saturated steam 2. Incidentally, reference numeral 20*a* in the drawing denotes a drawing and texturing (false-twisting) part.

According to the present invention, because the boiler 7 for the heat medium liquid 1 is provided to the bottom surface 4 of the laterally extended closed container 3 and the level of the heat medium liquid surface 8 inside the boiler 7 is arranged at a position lower than the bottom surface 4 inside the closed container 3, the entire outer peripheral surface 5*d* of the heat absorbing part 5*a* of the hot pin 5 keeps always in contact with the saturated steam 2 but does not come into contact with the heat medium liquid 1 even partially. Therefore, heat exchange can be made by means of heat conduction of the metal material constituting the hot pin 5 while the latent heat of the saturated steam 2 keeps a predetermined temperature when the filament yarns 16 are heated.

Figure 9:
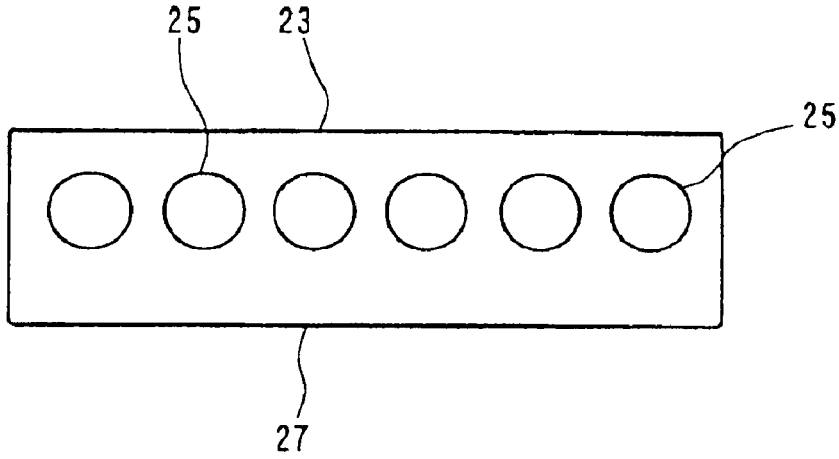
FIG. 9 PRIOR ART
FIG. 9 is a front view of a heat treatment device for synthetic fiber filament yarns according to the prior art.
Figure 10:
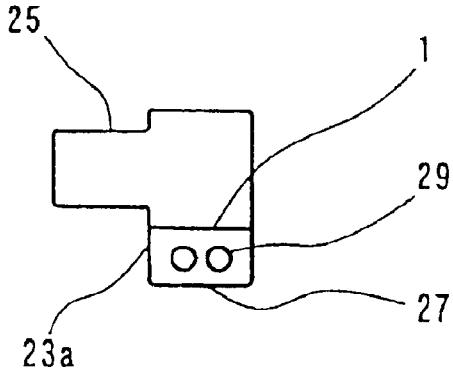
FIG. 10 PRIOR ART
FIG. 10 is a right-hand side view of FIG. 9.
Figure 11:
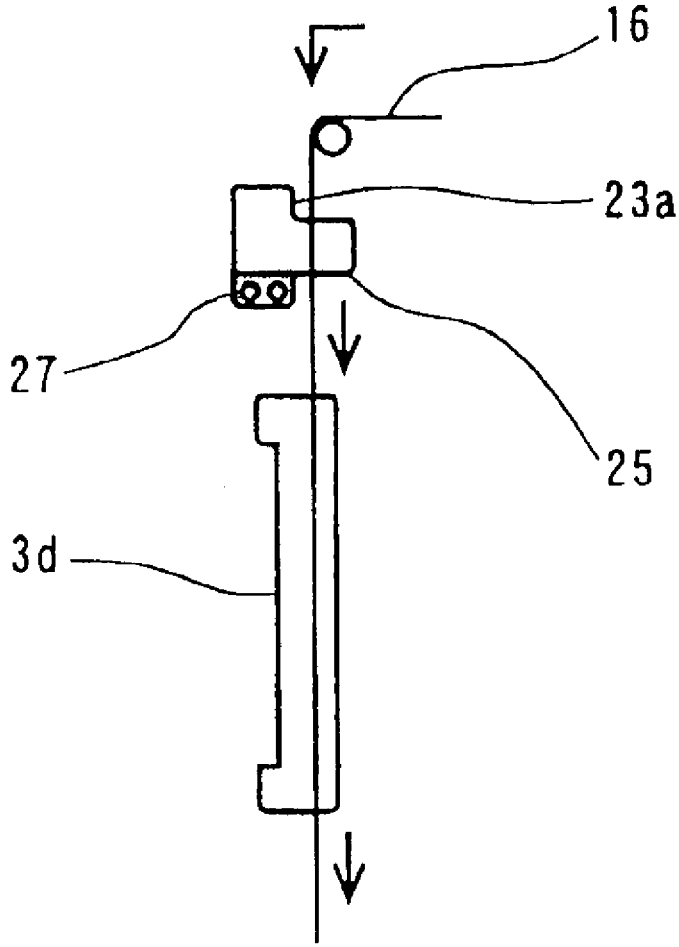
FIG. 11 PRIOR ART
FIG. 11 is a side view of a setup when the heat treatment device for synthetic fiber filament yarns according to the prior art is arranged.

In contrast, in the device according to the prior art as shown in FIGS. 9 and 10, cylindrical hot pins 25 are provided to one of the side surfaces 23*a* of a laterally extended closed container 23 in such a fashion as to protrude outward from the closed container 23. A boiler 27 is disposed on the internal bottom surface of the closed container 23, and a heater 29 heats heat medium liquid 1 inside the boiler 27 so that its saturated steam can heat the hot pins 25. Therefore, when the prior art device is arranged above a vertically extended hot plate 3*d* as shown in FIG. 11, the overall height becomes great and it becomes difficult to secure a building for installing the setup therein.

Figure 4:
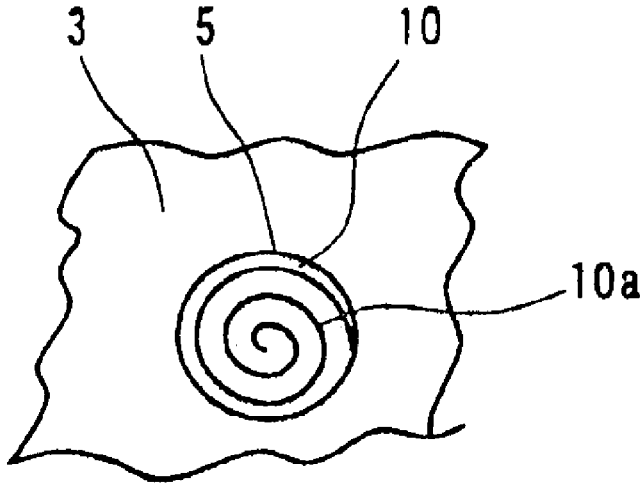
FIG. 4 is an enlarged plan view of a part of FIG. 1 showing another embodiment of the present invention.
Figure 5:
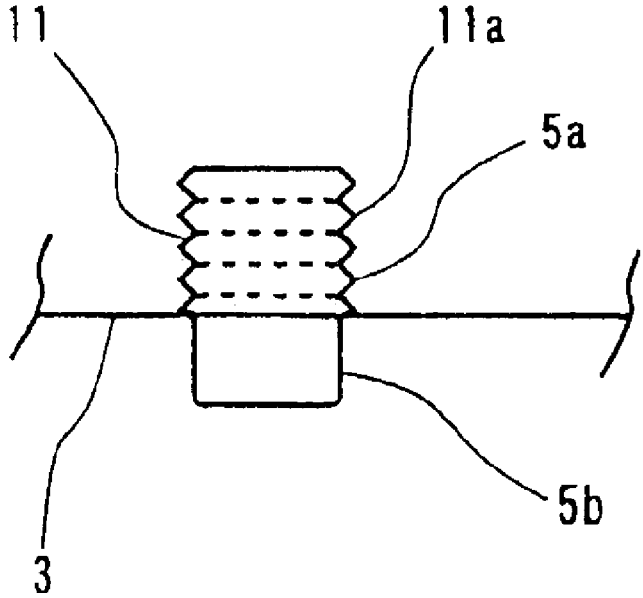
FIG. 5 is a front view of FIG. 4.

The embodiment of the present invention is not limited to the embodiment described above but it can be partially changed or partial addition may also be made within the scope of the present invention. For example, as shown in FIG. 4, a heat transfer surface 10*a* having a spiral concavo-convex groove may be formed on at least the end face 10 of the heat absorbing part 5*a* of each cylindrical hot pin 5 positioned inside 3*a* of the closed container 3 and shaped by casting or machining. Alternatively, as shown in FIG. 5, a heat transfer surface 11*a* having a spiral concavo-convex groove may be formed on at least the outer peripheral surface 11 of the heat absorbing part 5*a* of each cylindrical hot pin 5 positioned inside the closed container 3.

Figure 6:
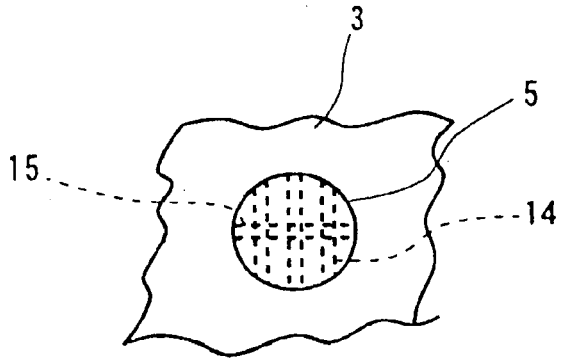
FIG. 6 is a plan view of a portion shown in FIG. 4 showing another embodiment of the present invention.
Figure 7:
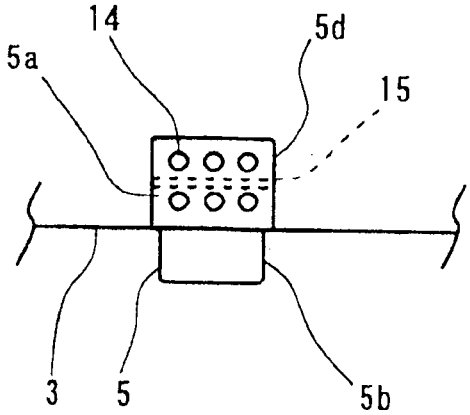
FIG. 7 is a front view of FIG. 6.

Furthermore, as shown in FIGS. 6 and 7, it is possible to integrally form communication holes 14 and 15 in such a fashion as to penetrate through the outer peripheral surface 5*d* of the heat absorbing part 5*a* of the cylindrical hot pin 5 positioned inside 3*a* of the closed container 3 and to extend from one side surface to the other of the outer peripheral surface 5*d*.

When these communication holes 14 and 15 are formed, the contact area between the heat absorbing part 5*a* of the hot pin 5 and the saturated steam 2 becomes by far greater than when they are not formed, and heat of the saturated steam 2 can be efficiently transferred to the heat absorbing part 5*b* of the hot pin 5.

In the heat treatment device for the synthetic fiber filament yarns according to the present invention, a plurality of cylindrical hot pins 5 each having the heat absorbing part 5*a* and the heat discharging part 5*b* are integrally fixed with the bottom surface 4 of the laterally extended closed container 3 for closing the saturated steam 2 of the heat medium liquid 1 in such a fashion as to penetrate through the bottom surface 4 from the inside 3*a* of the closed container 3 to its outside 3*b* with the axes 6 of the hot pins 5 extending in a vertical direction. Therefore, when this heat treatment device is installed under the laterally extended state as a part of the drawing and texturing (false-twisting) device 20 of the synthetic fiber, the overall height of the setup can be reduced, and a building in which the setup is installed can be easily secured.

According to the present invention, the boiler 7 for the heat medium liquid 1 is provided to the bottom surface 4 of the laterally extended closed container 3 and the level of the heat medium liquid surface 8 inside the boiler 7 is arranged at the position lower than the bottom surface 4 of the laterally extended closed container 3. Therefore, the outer peripheral surface 5*d* of the heat absorbing part 5*a* of the hot pin 5 does not some into contact with the heat medium liquid 1 but its entire surface always keeps contact with the saturated steam 2 and executes heat conduction. Consequently, the hot pin 5 can be heated to the predetermined temperature by the latent heat of the saturated steam 2.

What is claimed is:

1. A heat treatment device for synthetic fiber filament yarns comprising:

cylindrical hot pins each having a heat absorbing part and a heat discharging part, a laterally extended closed container for closing saturated steam of heat medium liquid, wherein said cylindrical hot pins are integrally formed with a bottom surface of said laterally extended closed container in such a fashion as to penetrate through said bottom surface from the inside to the outside of said closed container with axes of said hot pins extending in a vertical direction, a boiler for said heat medium liquid provided to the bottom surface, wherein a level of a heat medium liquid surface inside said boiler is arranged at a position lower than the bottom surface inside said laterally extended closed container.

2. A heat treatment device for synthetic fiber filament yarns according to claim 1, further comprising:

a heat transfer surface having a concavo-convex groove formed on at least an outer peripheral surface of said heat absorbing part of said cylindrical hot pin positioned inside said closed container.

3. A heat treatment device for synthetic fiber filament yarns according to claim 2, further comprising:

communication holes formed to extend from one side surface to the other of outer peripheral surface of said heat absorbing part of said cylindrical hot pin positioned inside said closed container.

4. A heat treatment device for synthetic fiber filament yarns according to claim 1, further comprising:

a heat transfer surface having a concavo-convex groove formed on at least an end face of said heat absorbing part of said cylindrical hot pin positioned inside said closed container.

5. A heat treatment device for synthetic fiber filament yarns according to claim 4, further comprising:

communication holes formed to extend from one side surface to the other of outer peripheral surface of said heat absorbing part of said cylindrical hot pin positioned inside said closed container.

6. A heat treatment device for synthetic fiber filament yarns according to claim 1, further comprising:

communication holes formed to extend from one side surface to the other of outer peripheral surface of said heat absorbing part of said cylindrical hot pin positioned inside said closed container.

* * * * *